US007317467B2

(12) United States Patent
Shepherd et al.

(10) Patent No.: US 7,317,467 B2
(45) Date of Patent: Jan. 8, 2008

(54) SYSTEM FOR CONTROLLING PRINTER COOLING FAN

(75) Inventors: Benjamin Kyle Shepherd, Versailles, KY (US); Kevin Dean Schoedinger, Lexington, KY (US); Phil Wright, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 265 days.

(21) Appl. No.: 10/968,391

(22) Filed: Oct. 19, 2004

(65) Prior Publication Data

US 2006/0083535 A1 Apr. 20, 2006

(51) Int. Cl.
*B41J 2/385* (2006.01)
*G03G 21/20* (2006.01)

(52) U.S. Cl. ..... 347/133; 399/92

(58) Field of Classification Search ..... 399/18, 399/37–70, 91–94, 122, 320, 9, 33; 347/228, 347/155–156, 133, 194, 234–235, 248–250; 388/831; 355/30

See application file for complete search history.

(56) References Cited

U.S. PATENT DOCUMENTS

| | | | | |
|---|---|---|---|---|
| 4,903,072 | A * | 2/1990 | Iwata | 355/30 |
| 5,457,766 | A * | 10/1995 | Ko | 388/831 |
| 6,324,361 | B1 * | 11/2001 | Itoh et al. | 399/92 |
| 6,374,063 | B1 * | 4/2002 | Todome | 399/18 |
| 6,539,185 | B2 * | 3/2003 | Hanyu et al. | 399/67 |
| 6,847,795 | B2 * | 1/2005 | Hirose et al. | 399/92 |
| 6,985,677 | B2 * | 1/2006 | Yamagata et al. | 399/18 |

* cited by examiner

*Primary Examiner*—Hai Pham
(74) *Attorney, Agent, or Firm*—Luedeka, Neely & Graham, P.C.

(57) ABSTRACT

A control system for a cooling fan of a laser printer enables selection of fan speed based on the actual degree of usage of the printer. The system provides first and second sets of fan speeds where each set contains information corresponding to a plurality of fan speeds. Information regarding the current operational condition of the fuser of the printer is periodically obtained, preferably during a preset interval. The fan is then operated at one of the fan speeds of the first or second set of fan speeds, with the selection of the first or second set and the selection of one of the fan speeds based on the current operational condition of the fuser. In this manner, the speed of the fan is substantially continuously controlled based on the operational condition of the printer.

4 Claims, 2 Drawing Sheets

SYSTEM FOR CONTROLLING PRINTER COOLING FAN

FIELD OF THE INVENTION

The invention relates to the control of cooling fans of electrophotographic devices. In particular, the invention relates to a control system and associated method which enables improved control of the fan based on the work load of a printer.

BACKGROUND

Electrophotographic devices, such as laser printers, utilize heat to fuse toner to paper to provide printed images. For example, a fuser of the printer is provided by a nip defined by one or a pair of heated rollers. As the print media, typically paper, is passed through the rollers, toner corresponding to the indicia to be printed is melted and fused with the fibers in the paper. During printing operations substantial heat is generated and it is important to control the temperature of the interior of the printer. Cooling fans are typically employed to circulate air through the printer to control the temperature of the interior of the printer.

Laser printers typically include a computerized printer engine that controls the operation of all aspects of the printer. The printer engine typically includes a fan control unit as a subpart thereof. Typically, the fan control unit utilizes a fan control program that selects a low fan speed when the printer is idle and a higher fan speed when the printer is in use. This manner of fan speed control needs improvement, particularly as the fan speeds are selected for worst case conditions, but for minimal printing operations, these speeds result in undesirable and unnecessary noise.

The present invention relates to an improved control system for a laser printer. The control system utilizes a control program which is preferably incorporated into the computer code of the printer engine and facilitates selection of multiple sets of fan speeds based on the actual degree of usage of the printer, as opposed to a constant set of predetermined speeds corresponding to "printing" and "idle" conditions as is utilized in conventional control systems.

In this manner, the invention enables improved control over the operation of printer cooling fans without the need for additional sensors or other equipment. This advantageously provides more customized control of fan speed and avoids unnecessary noise often associated with printer fans operating at a higher than necessary speed during minimal printing operations.

SUMMARY OF THE INVENTION

With regard to the foregoing, the invention provides, in one aspect, a method for controlling the speed of a fan for cooling of a laser printer of the type operationally controlled by a microcomputer having memory and including a heatable fuser for fusing toner to a print media during printing.

In a preferred embodiment, the method includes a step wherein a database of fan speed information operatively associated with the microcomputer is provided. The database provides first and second sets of fan speeds, each set having information therein corresponding to a plurality of fan speeds by which the microcomputer can control the fan speed of the fan. Information corresponding to the current operational condition of the fuser is thereafter periodically obtained, preferably during a preset interval (e.g., about every 10 msec.). The fan is then operated at one of the fan speeds of the first or second set of fan speeds, with the selection of the first or second set and the selection of one of the fan speeds thereof being based on the current operational condition of the fuser and/or location of the media relative to the fuser, such that the speed of the fan is substantially continuously controlled based on the operational condition of the printer.

This advantageously enables repeated selection of a number of different fan speeds for operating conditions of the printer, such as the "printing" and "idle" conditions of the printer based on the actual degree of usage of the printer. Thus, if the printer is experiencing relatively low usage and is relatively cool, the fan speed could be very low or off when the printer is idle. Likewise, if the printer has just finished a large amount of printing and is relatively hot, but has recently changed to an inactive or non-printing status, a desired fan speed may be selected to provide adequate cooling.

This offers considerable advantages over conventional cooling systems which provide a single set of fan speeds, such as one for "idle" circumstances and one for "printing" circumstances. Thus, such systems do not enable control of the fan speed based on the degree of usage of the printer, often resulting in insufficient cooling for some situations and in excessive cooling (and thus excessive noise) in other situations.

In other aspects, the invention relates to control systems for controlling the operation of cooling fans of laser printers of the type having heatable fusers, and to laser printers incorporating such control systems.

In a preferred embodiment, the control systems include a microcomputer; a sensor operatively associated with the fuser and the microcomputer for providing information to the microcomputer corresponding to the temperature of the fuser and the presence or absence of print media within the fuser; and a database operatively associated with the microcomputer. The database includes first and second sets of fan speeds, each set having information therein corresponding to a plurality of fan speeds. The first and second sets of fans speeds are selected to correspond to operating conditions of the fuser relating to the temperature of the fuser and the presence or absence of print media within the fuser.

In accordance with another aspect of the invention, a printer includes a printing mechanism for depositing toner on a media, and the printing mechanism has a plurality of operational states having different power requirements and producing different amounts of thermal energy. A microcomputer controls the operation of the printing mechanism and periodically determines information as to the operational state of the printing mechanism. A joule count is maintained by the microcomputer and the joule count is repetitively incremented and decremented based on the periodically obtained information. A fan speed signal is produced by the microcomputer based upon at least the joule count, and the fan speed signal includes at least two different fan speeds signals, a lower fan speed signal for a lower joule count and a higher fan speed signal for a higher joule count. A fan and fan control system receives the fan speed signal and is responsive to the lower fan speed signal to operate the fan at a relatively lower speed and is responsive to the higher fan speed signal to operate the fan at a relatively higher fan speed.

In accordance with a more particular aspect of the invention, the microcomputer periodically increments the joule count when the printing mechanism is in the operational state of "Printing", and no media is in the fuser nip and periodically decrements the joule count when the printing mechanism is in the operational state of "Printing" and media is in the fuser nip. The microcomputer periodically decrements the joule count when the printing mechanism is in the operational state of "Off" and when printing mechanism is in the operational state of "Standby". "Printing" is this context means the printer's mechanism is in the process of getting all components of a printer at the target speed and temperature for printing or maintaining speed and temperature for printing.

BRIEF DESCRIPTION OF THE DRAWINGS

Further advantages of the invention can be better understood by reference to the detailed description when considered in conjunction with the figures, which are not to scale and which are provided to illustrate the principles of the invention. In the drawings, like reference numbers indicate like elements through the several views.

DETAILED DESCRIPTION OF THE INVENTION

Figure 1:
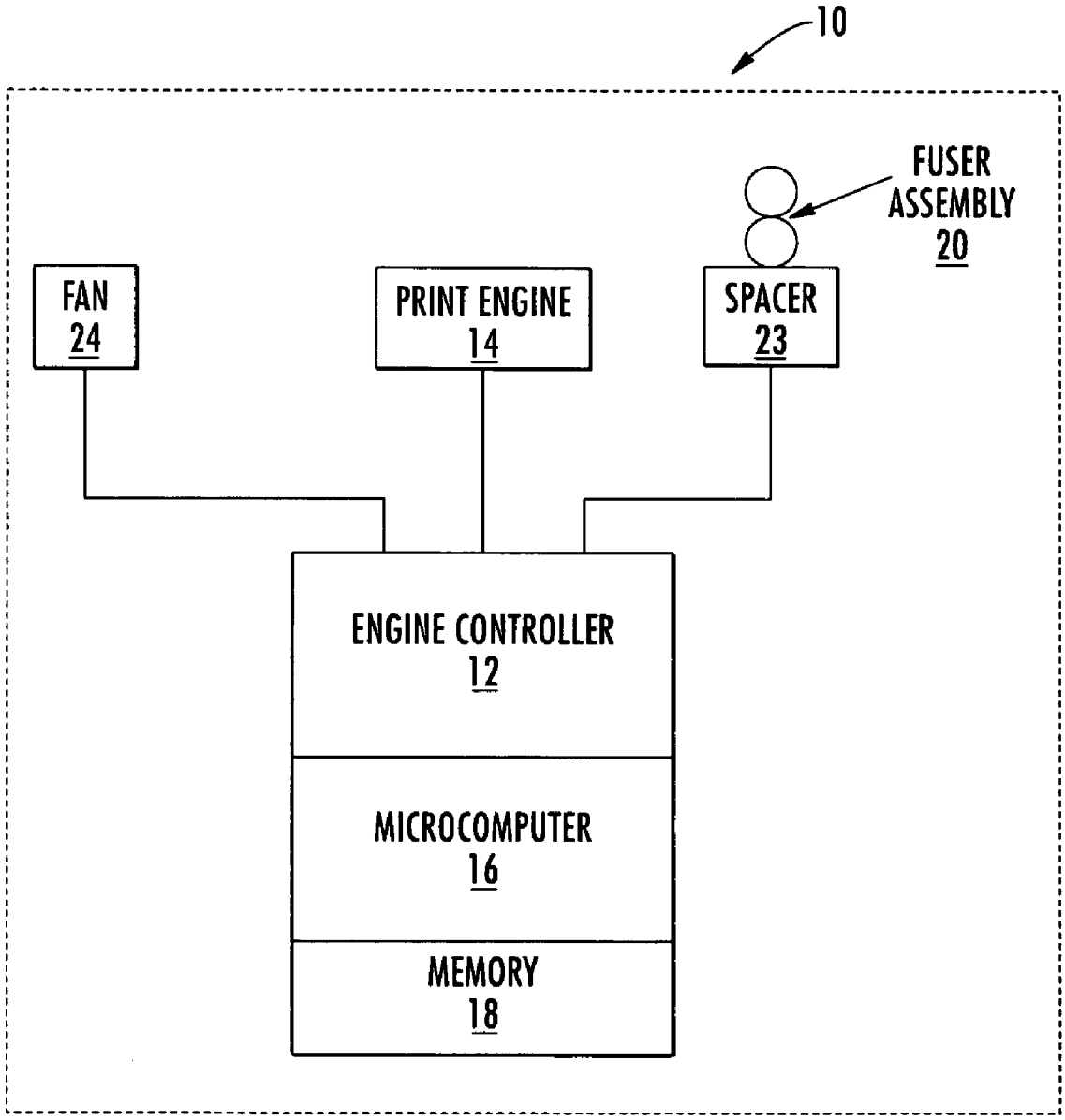
FIG. 1 is a schematic diagram of a control system in accordance with a preferred embodiment of the invention.

With reference to FIG. 1, the present invention relates to an improved control system 10 for a printer such as a laser printer. The present invention is described below with reference to a laser printer, but it has applications to other printers as well. The control system 10 is operatively associated with an engine controller 12 which controls the overall operation of the printer including operation of a print engine 14 of a laser printer.

The controller 12 includes a programmed microcomputer 16 and one or more memory units 18 for storing programs to be run thereon. The memory units 18 preferably include non-volatile memory storage (NVRAM). In this regard, it will be understood that "RAM" or random access memory is integrated-circuit (IC) memory whose contents can both be read and over-written as required; it forms the 'main memory' of most microcomputer systems. Normally, RAM is 'volatile' and loses its contents when the power to the printer is switched off. NVRAM has associated retention capabilities and is able to retain its contents.

As will be appreciated, a variety of printer components are operated under control of the engine controller 12 including, but not limited to, paper feed mechanisms, the fuser assembly 20 having an associated temperature sensor 22, such as a thermistor which typically provides temperature information concerning the fuser as well as operational status about the fuser to the controller 12, and, for the primary purpose of this disclosure, a cooling fan 24. The fan 24 and controller 12 are in part a fan and fan control system that provides power to the fan and controls its speed. The engine controller 12 operates on a cyclical basis in relation to a pre-selected interval or counter, wherein the controller checks conditions or otherwise takes action at a pre-selected interval, commonly in the order of every 10 milliseconds. The cycle is typically referred to as the "heartbeat."

The system 10 utilizes a control program which is preferably incorporated into the computer code of the controller 12 of the printer and is stored in the memory 18. The system 10 facilitates repeated selection of a number of different fan speeds for the "printing" and "idle" conditions of the printer based on the actual degree of usage of the printer, as opposed to a constant set of predetermined speeds corresponding to "printing" and "idle" conditions as is utilized in conventional control systems. That is, conventional printers typically have a set fan speed for "idle" conditions and a set fan speed for "printing" conditions. This can result in states of insufficient cooling or excessive cooling (and excessive noise), since the fan speeds are based only on whether or not the printer is printing.

For example, if the printer is initially turned on and starts a small printing task, the fan will operate at the set "printing" speed, which is generally a high speed set to cover the upper range of use. Likewise, if the printer just finished a small printing task and goes idle, the fan will operate at the set "idle" speed, which is generally a high speed set to cover the upper range of use. This results in greater fan speed than is required for cooling and results in undesirable noise levels. The invention advantageously enables the selection of different sets of "idle" and "printing" fan speeds in relation to the actual usage of the printer. Thus, in the case of an initially cold printer (Just having been turned on), the invention enables operation of the printer so that a lower fan speed will be provided during low usage printing events, with the fan speed being adjusted to higher levels should the usage increase. Likewise, the invention enables operation of the printer so that a higher fan speed will be provided when the printer becomes "idle" after heavy usage, with the fan speed being adjusted to lower levels as the printer cools.

Figure 2:
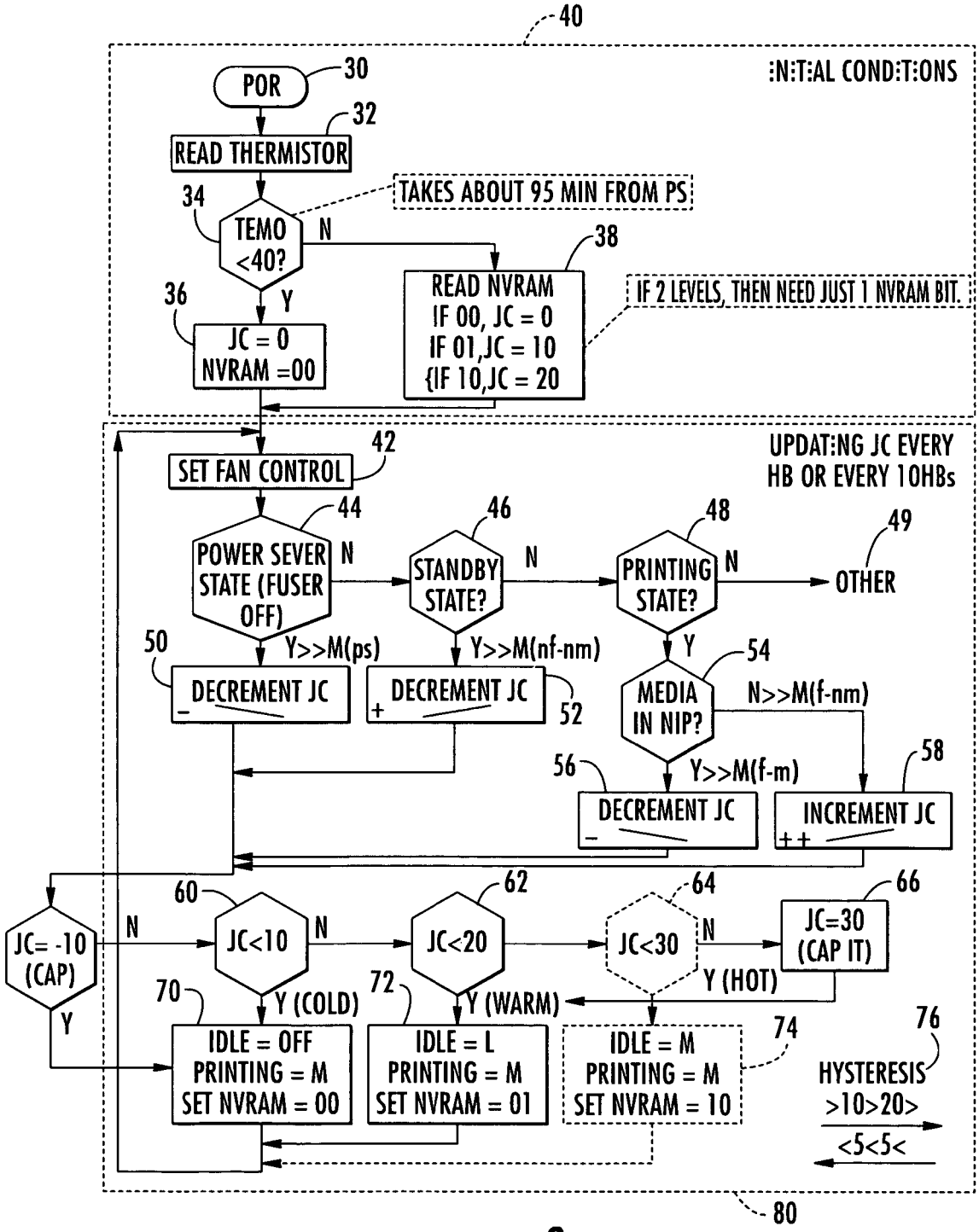
FIG. 2 is a flowchart illustrating programs used in the control system of FIG. 1.

FIG. 2 depicts flowcharts for software programs or subroutines used in the controller 12, and which assist in the operation thereof. In one embodiment, the programs are written in a suitable program language, such as C, and stored in the memory 18. However, as will be appreciated, the controller 12 may be replaced by an application specific integrated circuit operating in the manner as described herein. Also, the programs could be run on a server and connected to the printer. The program is preferably associated with the NVRAM memory so as to not be affected by printer power cycles (on/off).

As seen in FIG. 2, the program begins at a step 30 of power-on-reset (POR), wherein the power to the printer is turned on. Next, in step 32, current temperature information from the sensor 22 is referenced to obtain a fuser temperature value. This value is compared in step 34 to a preselected reference value, such as 40° C. If the value is less than the reference value, then in step 36 a variable JC is selected to have a value of 0, and a variable NVRAM stored in the NVRAM memory is selected to have a value of 00. If the value is greater or equal to the reference value, then in step 38 the value of the NVRAM currently stored in the NVRAM memory is obtained and the variable JC is selected based on the NVRAM value. The steps 30-38 as segregated by dashed line 40 represent a subroutine configured to set initial conditions. Alternatively, one can use 40° C. as an initial condition by itself to seed the JC and select from multiple sets of fan speeds. NVRAM would not be needed in this case.

As used herein, the variable JC is selected in a manner to correspond to the use level of the printer. For example, a low value corresponds to a condition wherein the fuser is off. A high value for the variable JC corresponds to a condition wherein the fuser is in active printing mode. An intermediate value corresponds to a condition wherein the fuser is on, but not presently in use. Thus, in accordance with steps 30-38, the variable JC is assigned a value corresponding to information concerning the use level of the printer. As will be appreciated, additional value states may be provided for the JC variable if desired, e.g., high intermediate, low intermediate, etc. In a like manner, the variable NVRAM is assigned a value commensurate with the JC value. As will be described more fully below, the value of the JC variable is used to select different sets of "idle" and "printing" fan speeds.

In a preferred embodiment, the JC variable is assigned values of either 0, 10, or 20, with zero representing no printer usage, 10 representing the fuser being in a standby or low use state, and 20 representing a high use state. In this regard, it will be understood that additional values may be assigned, including higher, lower or incrementally higher and lower values. However, in accordance with the invention, it is preferred to have at least three values from which the JC variable is initially selected.

In a similar manner, the NVRAM variable is assigned values of either 00, 01, or 10, corresponding to the JC values of 0, 10, and 20, respectively, it being understood that additional values may be assigned, including higher, lower or incrementally higher and lower values. However, it is likewise preferred to have at least three values from which the NVRAM variable is initially selected.

The initial values of the JC and NVRAM variables are used to select the speed of the cooling fan 24 for different printer status states, such as an inactive or "idle" condition of the printer and an active or "printing" condition. However, it will be understood that additional printer status states and fan speed settings may be included, it being preferred to have at least two different status states and associated fan speeds.

In a preferred step 42, the "idle" and "printing" speeds of the cooling fan 24 are selected to establish the operating speed of the fan for various printer status states, such as when the printer is in use and when the printer is idle or not printing. For example, if the JC and NVRAM values indicate that the printer usage has been relatively low, then the fan speed may be selected to be zero or a relatively low level if the printer is not printing. If the printer is then activated and begins a print job, the fan speed will be adjusted to a new, higher value. However, even this value will preferably be relatively low, since the printer has not been extensively used. Likewise, as the printer use conditions increase, the control system enables modification of the idle and printing fan speeds commensurate with the use of the printer. Thus, in each case, the fan will be operated at selected sets of speeds corresponding to the printer status state and the actual usage of the printer, with the control system enabling modification of the sets of speeds depending upon the use conditions of the printer.

Following this, in steps 44-48, a query is made as to the operational status of the fuser. The information concerning the operational status corresponds to information available to the controller 12 via the sensor 22. Fusers typically have three operational states: off, standby, and printing, however, it will be understood that additional states may be identified and corresponding steps included. Thus, in step 44, a query is made as to whether the fuser is off. In step 46 a query is made as to whether the fuser is in a standby state. In step 48 a query is made as to whether the fuser is in a printing state.

Retuning to step 44, if the fuser is "on," then the program flows to step 46. If the fuser is "off," then the program flows to step 50. In step 50, the value of the JC variable is decreased by a predetermined weight factor. Preferably, this weight factor corresponds to a preselected rate of decrement multiplied by a time value, such as the printer heartbeat. As noted previously, the program updates itself periodically, preferably corresponding to the heartbeat of the printer, or every 10 msec. Thus, the JC value will continue to be decremented until the minimum value of the set is reached, e.g., −10. From step 50, the program flows to step 60, described below following the discussion of step 58.

In a similar manner, as seen in step 46, if the fuser is not in a "standby" state, then the program flows to step 48. If the fuser is in a "standby" state, then the program flows to step 52. In step 52, the value of the JC variable is increased by a predetermined weight factor. Preferably, this weight factor corresponds to a preselected rate of increment multiplied by a time value, such as the printer heartbeat. The weight factor may be the same or different from that of step 50. From step 52, the program flows to step 60 described below.

Likewise, in step 48, if the fuser is not "off" or in "standby" mode, it is determined to be in a printing state (unless other status states are determined and incorporated as options as in step 49). Accordingly, the program flows to step 54. In step 54, a query is made as to whether or not print media, e.g., paper, is present in the nip defined by the heated rollers of the fuser. The information concerning the presence or absence of print media in the nip corresponds to information available to the controller 12 via the sensor 22 and/or other sensors in the printer. If media is present in the nip, the program flows to step 56. If media is not present in the nip, the program flows to step 58.

In step 56, the value of the JC variable is decreased by a predetermined weight factor. Preferably, this weight factor corresponds to a preselected rate of decrement multiplied by a time value, such as the printer heartbeat. As noted previously, the program updates itself periodically, preferably corresponding to the heartbeat of the printer, or every 10 msec. Thus, the JC value will continue to be decreaseduntil the minimum value of the set is reached, e.g., −10. From step 56, the program flows to step 60.

In step 58, the value of the JC variable is increased by a predetermined weight factor. Preferably, this weight factor corresponds to a preselected rate of increment multiplied by a time value, such as the printer heartbeat. The weight factor may be the same or different from that of step 56. From step 58, the program flows to step 59 described below.

At step 59, the value of the JC variable is checked. If the variable is equal to negative ten (−10), the program moves to step 70 described below. In the variable is not equal to negative ten, the program moves to step 60 where a query is made as to the value of the JC variable compared to a preselected reference value, such as 10 as shown therein. If the value of the JC variable in step 60 is not less than the preselected reference value, the program flows to step 62, wherein another query is made as to the value of the JC variable compared to another preselected and preferably higher reference value, such as 20 as shown therein. If the value of the JC variable in step 62 is not less than the preselected reference value, the program flows to step 64, wherein another query is made as to the value of the JC variable compared to another preselected and preferably higher reference value, such as 30 as shown therein. If the value of the JC variable in step 64 is not less than the preselected reference value, the program flows to step 66, wherein the value of the JC variable is capped or set to a preselected upper limit, such as 30 as shown. From step 66, the program flows to step 74, described below.

Returning to step 60, if the value of the JC variable in step 60 is less than the preselected reference value, the program flows to step 70. In step 70, the value of the JC variable having been determined to be below a certain threshold, the fan speed is selected to correspond to desired sets of "idle" and "printing" fan speeds. For example, in this case, the value of the JC variable is below 10. This corresponds to a relatively low printer usage level and thus, it is preferred that the "idle" and "printing" speeds of the set be selected to be relatively low, with the "printing" fan speed corresponding to a speed considerably below (and quieter) than fan speeds typically associated with printing operations. As used herein, "off" or zero RPM is considered a fan speed, and one "low" fan speed that could be selected is zero RPM or off. In addition, the value of the NVRAM variable is set to a preselected value corresponding to the relatively low JC value, and most preferably 00. Thus, if the printer were shut off and turned back on, the stored NVRAM value would be 00. Alternatively, one could also use a value corresponding to 40° C. as the initial condition only to seed the JC Variable (NVRAM)

Returning to step 62, if the value of the JC variable in step 62 is less than the preselected reference value, the program flows to step 72. In step 72, the value of the JC variable having been determined to be below a certain threshold but above another, the fan speed is selected to correspond to desired sets of "idle" and "printing" fan speeds. For example, in this case, the value of the JC variable is below 20 and above 10. This corresponds to an intermediate printer usage level and thus, it is preferred that the "idle" speed of the fan be selected to be relatively low, but higher than the "idle" speed of step 70, with the "printing" fan speed corresponding to a speed below (and quieter) than fan speeds typically associated with printing operations, but higher than the speed of step 70. In addition, the value of the NVRAM variable is set to a preselected value corresponding to the intermediate JC value, and most preferably 01. Thus, if the printer were shut off and turned back on, the stored NVRAM value would be 01.

Returning to step 64, if the value of the JC variable in step 64 is less than the preselected reference value, the program flows to step 74. In step 74, the value of the JC variable having been determined to be below a certain threshold but above another, the fan speed is selected to correspond to desired sets of "idle" and "printing" fan speeds. For example, in this case, the value of the JC variable is below 30, but greater than 20. This corresponds to a relatively high printer usage level and thus, it is preferred that the "idle" speed of the fan be selected to be higher than the "idle" speed of step 72, with the "printing" fan speed corresponding to a higher speed generally corresponding to the fan speed typically associated with printing operations, but higher than the speed of step 72. In addition, the value of the NVRAM variable is set to a preselected value corresponding to the intermediate JC value, and most preferably 10. Thus, if the printer were shut off and turned back on, the stored NVRAM value would be 10. As noted above, for higher JC values wherein step 66 is encountered, the program flows from step 66 to step 74.

Following completion of the step 70, or 72, or 74, the program returns to the step 42 and the fan speeds are set according to the criteria selected in step 70, 72, or 74. In this regard, the steps 42-74 as segregated by dashed line 80 represent a subroutine configured to run every heartbeat of the printer to reevaluate the JC and NVRAM variables and to alter or maintain the previously selected fan speeds.

In this manner, the system of the invention enables selection of a multitude of varying fan speeds based on the actual degree of usage of the printer, as opposed to a constant set of predetermined speeds corresponding to "printing" and "idle" conditions as is utilized in conventional control systems. This advantageously provides more customized control of fan speed and avoids unnecessary noise often associated with printer fans operating at a higher than desired speed during minimal printing operations.

It should be noted that as the JC variable reaches a threshold that changes the fan speed, a form of hysteresis 76 should be implemented to ensure the fan doesn't alterate between sets of speeds that may be a nuisance. In this embodiment, for example, the set of fan speeds will change when the J≧10, but the JC must be <5 before the fan speeds are changed back to the lower set of speeds.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. A control system for controlling the speed of a fan for cooling a laser printer of the type having a heatable fuser for fusing toner to print media during printing, the control system comprising:

one or more sensors for providing printer information corresponding to one or more of the temperature of one or more components of the laser printer, the operational state of the laser printer and the presence or absence of print media within the laser printer; and a microcomputer for periodically incrementing or decrementing a counter value based at least in part on the printer information and for controlling the speed of the fan based at least in part on the counter value, wherein the microcomputer causes the fan to operate at a first speed when the counter value is within a first range and the laser printer is in an idle state, the microcomputer causes the fan to operate at a second speed when the counter value is within the first range and the laser printer is in a printing state, the microcomputer causes the fan to operate at a third speed when the counter value is within a second range and the laser printer is in the idle state, and the microcomputer causes the fan to operate at a fourth speed when the counter value is within the second range and the laser printer is in the printing state.

2. The control system of claim 1 wherein the microcomputer periodically increments or decrements the counter value based at least in part on the printer information indicating that the printer is in the idle state or the printing state.

3. The control system of claim 1 wherein the microcomputer initially sets the counter value to an initial value that is based at least in part on the temperature of one or more components of the laser printer.

4. A method for controlling the speed of a fan for cooling a laser printer of the type having a heatable fuser for fUsing toner to print media during printing, the method comprising:

(a) providing printer information corresponding to one or more of the temperature of one or more components of the laser printer, the operational state of the laser printer and the presence or absence of print media within the laser printer;

(b) periodically incrementing or decrementing a counter value based at least in part on the printer information;

(c) controlling the fan to operate at a first speed when the counter value is within a first range and the laser printer is in an idle state;

(d) controlling the fan to operate at a second speed when the counter value is within the first range and the laser printer is in a printing state;

(e) controlling the fan to operate at a third speed when the counter value is within a second range and the laser printer is in the idle state; and (f) controlling the fan to operate at a fourth speed when the counter value is within the second range and the laser printer is in the printing state.

* * * * *